US008152540B2

(12) United States Patent
Hattori et al.

(10) Patent No.: US 8,152,540 B2
(45) Date of Patent: Apr. 10, 2012

(54) CONNECTOR TERMINAL PROTECTION CAP AND HARNESS ASSEMBLY

(75) Inventors: Makoto Hattori, Aichi (JP); Kazuki Niwa, Aichi (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 12/681,084

(22) PCT Filed: Oct. 16, 2007

(86) PCT No.: PCT/JP2007/070128

§ 371 (c)(1),
(2), (4) Date: May 6, 2010

(87) PCT Pub. No.: WO2009/050781

PCT Pub. Date: Apr. 23, 2009

(65) Prior Publication Data

US 2010/0240238 A1 Sep. 23, 2010

(51) Int. Cl.
*H01R 13/44* (2006.01)

(52) U.S. Cl. ..... 439/135

(58) Field of Classification Search ..... 439/135, 439/149, 357, 358, 521; 174/138 F
See application file for complete search history.

(56) References Cited

U.S. PATENT DOCUMENTS 2,823,610 A * 2/1958 Frazer ..... 102/202.12
2,962,688 A * 11/1960 Werner ..... 439/320
3,450,828 A * 6/1969 Joly ..... 174/75 R
4,258,970 A * 3/1981 Bourdon et al. ..... 439/149
4,365,858 A * 12/1982 Karol ..... 439/135
4,640,575 A * 2/1987 Dumas ..... 385/134
4,840,547 A * 6/1989 Fry ..... 417/422

(Continued)

FOREIGN PATENT DOCUMENTS

JP 58-55377 U 4/1983

(Continued)

OTHER PUBLICATIONS

International Search Report of PCT/JP2007/070128, mailing date of Nov. 13, 2007.

(Continued)

*Primary Examiner* — Tulsidas C Patel
*Assistant Examiner* — Vladimir Imas
(74) *Attorney, Agent, or Firm* — Westerman, Hattori, Daniels & Adrian, LLP

(57) ABSTRACT

An object of the present invention is to provide a connector terminal protection cap for a harness and a harness assembly that are capable of protecting connector terminals provided on one end of a harness and that does not come off easily during transfer or transport but can be easily removed at an assembly site. Provided are a connector terminal protection cap that is made of plastic and is attached to a connector provided on one end of a harness to protect connector terminals, the connector terminal protection cap including a cap main body that has an opening at one end thereof that serves as a mating portion to be fitted to a connector main body and a cap-shaped cylinder portion that is formed integrally with and continuously from the mating portion to cover an outer circumference of the terminals, and a pair of pawl members and that are provided at opposing positions on an outer circumference of the mating portion of the cap main body, anchoring to the connector main body, thereby attaching the cap main body to the connector main body in a freely attachable/detachable manner.

16 Claims, 6 Drawing Sheets

U.S. PATENT DOCUMENTS

| | | | | |
|---|---|---|---|---|
| 4,902,238 | A * | 2/1990 | Iacobucci | 439/135 |
| 4,979,792 | A * | 12/1990 | Weber et al. | 385/53 |
| 5,202,949 | A * | 4/1993 | Hileman et al. | 385/134 |
| 5,382,177 | A * | 1/1995 | Hutchinson et al. | 439/358 |
| 5,414,790 | A * | 5/1995 | Lee et al. | 385/139 |
| 5,427,270 | A * | 6/1995 | Patterson | 174/135 |
| 5,622,642 | A * | 4/1997 | Edwards et al. | 219/542 |
| 5,967,823 | A * | 10/1999 | Tsui | 439/280 |
| 6,036,535 | A * | 3/2000 | Whiteman et al. | 439/519 |
| 6,182,904 | B1 * | 2/2001 | Ulczynski et al. | 239/1 |
| 6,291,774 | B1 * | 9/2001 | Williams | 174/139 |
| 6,318,038 | B1 * | 11/2001 | Park | 52/223.13 |
| 6,628,878 | B2 * | 9/2003 | Akeda et al. | 385/134 |
| 6,809,257 | B2 * | 10/2004 | Shibuya | 174/481 |
| 6,844,497 | B2 * | 1/2005 | Frantz et al. | 174/72 A |
| 7,060,899 | B1 * | 6/2006 | Hoefer | 174/491 |
| 7,114,982 | B2 * | 10/2006 | Shimizu et al. | 439/358 |
| 7,189,099 | B2 * | 3/2007 | Whyne et al. | 439/358 |
| 7,439,446 | B2 * | 10/2008 | Blase et al. | 174/95 |
| 7,470,858 | B2 * | 12/2008 | McNutt et al. | 174/67 |
| 7,554,034 | B2 * | 6/2009 | Smith | 174/53 |
| 7,626,120 | B1 * | 12/2009 | Golden et al. | 174/53 |
| 7,789,679 | B2 * | 9/2010 | Wu et al. | 439/135 |
| 7,798,829 | B2 * | 9/2010 | Fong | 439/148 |
| 2002/0013076 | A1 * | 1/2002 | Akeda et al. | 439/135 |
| 2002/0123262 | A1 * | 9/2002 | Andresen et al. | 439/358 |
| 2003/0183413 | A1 * | 10/2003 | Kato | 174/135 |
| 2006/0230781 | A1 | 10/2006 | Kawada et al. | |
| 2007/0012474 | A1 * | 1/2007 | McNutt et al. | 174/135 |
| 2010/0170698 | A1 * | 7/2010 | Hattori et al. | 174/135 |
| 2010/0300748 | A1 * | 12/2010 | Matsuoka et al. | 174/74 A |

FOREIGN PATENT DOCUMENTS

| | | | |
|---|---|---|---|
| JP | 2-67572 | U | 5/1990 |
| JP | 5-69824 | U | 9/1993 |
| JP | 8-124609 | A | 5/1996 |
| JP | 2001-243999 | A | 9/2001 |
| JP | 2002-056921 | A | 2/2002 |
| JP | 2006-322444 | A | 11/2006 |

OTHER PUBLICATIONS

Japanese Office Action dated Oct. 18, 2011, issued in corresoponding Japanese Patent Application No. 2009-537794.

* cited by examiner

CONNECTOR TERMINAL PROTECTION CAP AND HARNESS ASSEMBLY

TECHNICAL FIELD

The present invention relates to a connector terminal protection cap that is placed on a connector provided at one end of a harness to protect terminals and to a harness assembly equipped with the same.

BACKGROUND ART

A power supply cable (harness) is connected to an electric compressor of an air conditioner installed in a vehicle to provide power from a power source such as a battery and the like installed in a vehicle to an electric motor of the electric compressor. A connector, which is provided with positive and negative terminals used to connect to the power supply side, is provided at one end of this harness. As a constituent part at the electric compressor side, a harness is mounted to an electric compressor on a manufacturing line of the electric compressor, which is then transferred or transported to a vehicle assembly site to be installed in a vehicle. During transfer or transport of this electric compressor, dirt, dust, water droplets, etc. may become attached to the connector terminals of the harness, or damage thereto may occur from contact with other members. To prevent this, a connector terminal protection cap that protects the connector terminals is attached thereto, and transfer or transport is then carried out.

Examples of such connector terminal protection caps are disclosed in Patent Citations 1 and 2. These protection caps are attached to an electric cable end portion or a holder main body in order to prevent attachment of dirt, dust, water droplets, etc. to an end portion of an electric cable of a wire harness, a power supply core wire of a terminal block, etc., or to prevent bending, etc. of a core wire. The protection caps are formed of molded products of plastic materials, have a cap portion that covers an outer circumference of the electric cable end portion and the power supply core wire, and are attached to the electric cable end portion or the holder main body by fitting thereto by means of elastic deformation of the plastic material.

The original function of a connector terminal protection cap is to prevent attachment of dirt, dust, water droplets, etc. to connector terminals or damage to the connector terminals, during transfer or transport of an electric compressor. However, with the connector terminal protection caps applied to the above-described harness, in addition to such a protective function, other required functions are not to come off easily due to vibrations, contact with other members, etc. during transfer or transport, and to be easily removed at an assembly site for smooth installation work.

The protection caps disclosed in Patent Citations 1 and 2 described above are attached by fitting by means of elastic deformation of plastic material. Accordingly, if the fitting force is weak, these caps may come off during transfer and transport due to vibrations, contact with other members, etc. There is also a problem in that, if the fitting force is too strong, pulling the caps off requires strength, and their removal becomes difficult at the assembly site.

Patent Citation 1: Japanese Unexamined Patent Application, Publication No. Hei 8-124609.

Patent Citation 2: Japanese Unexamined Patent Application, Publication No. 2001-243999.

DISCLOSURE OF INVENTION

The present invention has been conceived in light of the circumstances described above, and an object thereof is to provide a connector terminal protection cap and a harness assembly that are capable of protecting connector terminals provided at one end of a harness, that does not easily come off during transfer or transport, and that is easily removed at an assembly site.

To achieve the object described above, a connector protection cap and a harness assembly of the present invention employ the following solutions.

That is, a connector terminal protection cap according to the present invention is a connector terminal protection cap that is made of plastic and is attached to a connector provided at one end of a harness to protect terminals of the connector, including a cap main body that has an opening at one end thereof that serves as a mating portion to be fitted to a connector main body and a cap-shaped cylinder portion that is formed integrally with and continuously from the mating portion to cover an outer circumference of the terminals; and a pair of pawl members that are provided at opposing positions on an outer circumference of the mating portion of the cap main body, anchoring to the connector main body, thereby attaching the cap main body to the connector main body in a freely attachable/detachable manner.

With the above configuration, the cap main body with an opening at one end thereof serving as a mating portion is fitted to the connector main body and the pair of pawl members provided on the outer circumference of the mating portion are anchored to the connector main body, and thereby, the cap main body can be attached to the connector main body, covering the outer circumference of the connector terminals with the cap-shaped cylinder portion. Accordingly, the connector terminals are protected by covering the outer circumference thereof with the cap main body, and thus, attachment of dirt, dust, or water droplets, or damage to the connector terminals can be prevented. In addition, because the cap main body is attached to the connector main body in a freely attachable/detachable manner by engaging/unhooking of the pawl members, the cap main body is hard to come off during transfer or transport due to vibrations or contact with other members, but when removing the cap main body at an assembly site, it can be easily removed by unhooking the pawl members.

Furthermore, the connector terminal protection cap of the present invention is characterized in that, in the aforementioned connector terminal protection cap, the pair of pawl members are provided with pressing operation portions and pawl portions that are anchored to the connector main body; and these pawl portions and pressing operation portions are integrally formed on the outer circumference of the mating portion of the cap main body, with linkage portions interposed therebetween.

With the above-described configuration, it is possible to engage/unhook the pawl portions with/from the connector main body by operating the pressing operation portions of the pair of pawl members from both sides in a pinching manner, thus moving the pawl portions in accordance with the operating level. Accordingly, by operating the pressing operation portions of the pawl members, the cap main body can be easily attached to/detached from the connector main body.

In addition, the connector terminal protection cap of the present invention is characterized in that, in the aforementioned connector terminal protection cap, ribs are integrally formed, at least on an circumferential edge of the pressing operation portions of the pawl members.

With the above-described configuration, integrally forming the ribs on the circumferential edge locations of the pressing operation portions ensures the rigidity of the pressing operation portions. Therefore, it is possible to easily attach/detach the cap main body by reliably transmitting an operating force exerted on the pressing operation portions to the pawl portions, thus moving the pawl portions corresponding to the operating level.

Furthermore, the connector terminal protection cap of the present invention is characterized in that, in any of the above-described connector terminal protection caps, on one of the pair of pawl members, the pawl portion and the pressing operation portion are integrally and coplanarly provided; and on the other of the pair of pawl members, the pawl portion and the pressing operation portion are provided in a step-like manner relative to the linkage portion, with the pressing operation portion on an outer side thereof.

With the above-described configuration, with one of the pawl members, because the pawl portion moves approximately proportionally to the operating level of the pressing operation portion, it is possible to make the pawl portion relatively easy to come off. In addition, with the other pawl member, because the pawl portion and the pressing operation portion are provided in a step-like manner, it is possible to make the pawl portion hard to come off by making the amount of movement of the pawl portion small relative to the operating level of the pressing operation portion. Accordingly, it is possible to make the cap main body hard to come off due to vibrations, contact with other members, etc. while allowing for easy removal at an assembly site.

Furthermore, the connector terminal protection cap of the present invention is characterized in that, in the aforementioned connector terminal protection cap, on the step-like portion of the other pawl member, rear-surface ribs are integrally formed to extend to a rear surface of the pawl portion and a rear surface of the pressing operation portion, respectively.

With the above-described configuration, the other pawl member can be made hard to be deformed by an external force because the rigidity of the pawl portion and the pressing operation portion are both increased by the rear-surface ribs. Accordingly, it is possible to make it difficult for the cap main body to come off easily due to vibrations, contact with other members, etc.

Furthermore, the connector terminal protection cap of the present invention is characterized in that, in any of the above-described connector terminal protection caps, the mating portion of the cap main body is provided with a guiding hole that fits to a pin provided on the connector main body side.

With the above-described configuration, the cap main body can be attached by fitting the guiding hole on the cap main body side to the pin provided on the connector main body side. Accordingly, misalignment or misattachment can be prevented when attaching the cap main body.

Furthermore, the connector terminal protection cap of the present invention is characterized in that, in the aforementioned connector terminal protection cap, the guiding hole is a cross-shaped hole with protrusions provided on an inner circumferential surface thereof.

With the above-described configuration, with the protrusions provided on the inner circumferential surface of the guiding hole, the pin provided on the connector main body side can be appropriately guided to the center of the guiding hole and fitted thereto.

Furthermore, the connector terminal protection cap of the present invention is characterized in that, in any of the above-described connector terminal protection caps, the cap-shaped cylinder portion is formed by separating it with a partition for each of a plurality of the connector terminals.

With the above-described configuration, a plurality of the connector terminals can be protected by the cap-shaped cylinder portions separately formed for each terminal by the partition. Therefore, a plurality of the connector terminals can be protected by individually covering an outer circumference while avoiding interference with each other.

Furthermore, a harness assembly according to the present invention is characterized in that it is a harness assembly that is connected at one end to power source input terminals of an electric compressor and is provided with a connector at the other end to be connected to a power source, wherein any of the aforementioned connector terminal protection caps, which covers an outer circumference of terminals of the harness assembly, is attached to the connector main body in a freely attachable/detachable manner, via a pair of pawl members.

In the above-described configuration, to the connector main body of the harness that is connected to the power source input terminals of the electric compressor, the connector terminal protection cap, which covers the terminals of the connector main body, is attached via the pair of pawl members, and the electric compressor can be transferred or transported to an assembly site while protecting the connector terminals with the connector terminal protection cap. Therefore, during transfer or transport of the electric compressor, attachment of dirt, dust, or water droplets to the connector terminals or damage to the terminals is prevented, but installation of the electric compressor and connection of the harness to the power source side can be smoothly carried out at the assembly site.

With the connector terminal protection cap of the present invention, attachment of dirt, dust, or water droplets to the connector terminals or damage to the connector terminals can be prevented by protecting the connector terminals covering the outer circumference of the connector terminals with the cap main body. In addition, with engaging/unhooking of the pawl members, the cap main body is attached to the connector main body in a freely attachable/detachable manner; therefore, the cap main body is hard to come off due to vibrations, contact with other members, etc., during transfer or transport, but when removing it at an assembly site, the cap main body is easily removed by unhooking the pawl members.

In addition, with the harness assembly of the present invention, during transfer or transport of the electric compressor, attachment of dirt, dust, or water droplets to the connector terminals or damage to the terminals is prevented, but installation of the electric compressor and connection of the harness to the power source side can be smoothly carried out at the assembly site.

EXPLANATION OF REFERENCE

Figure 1:
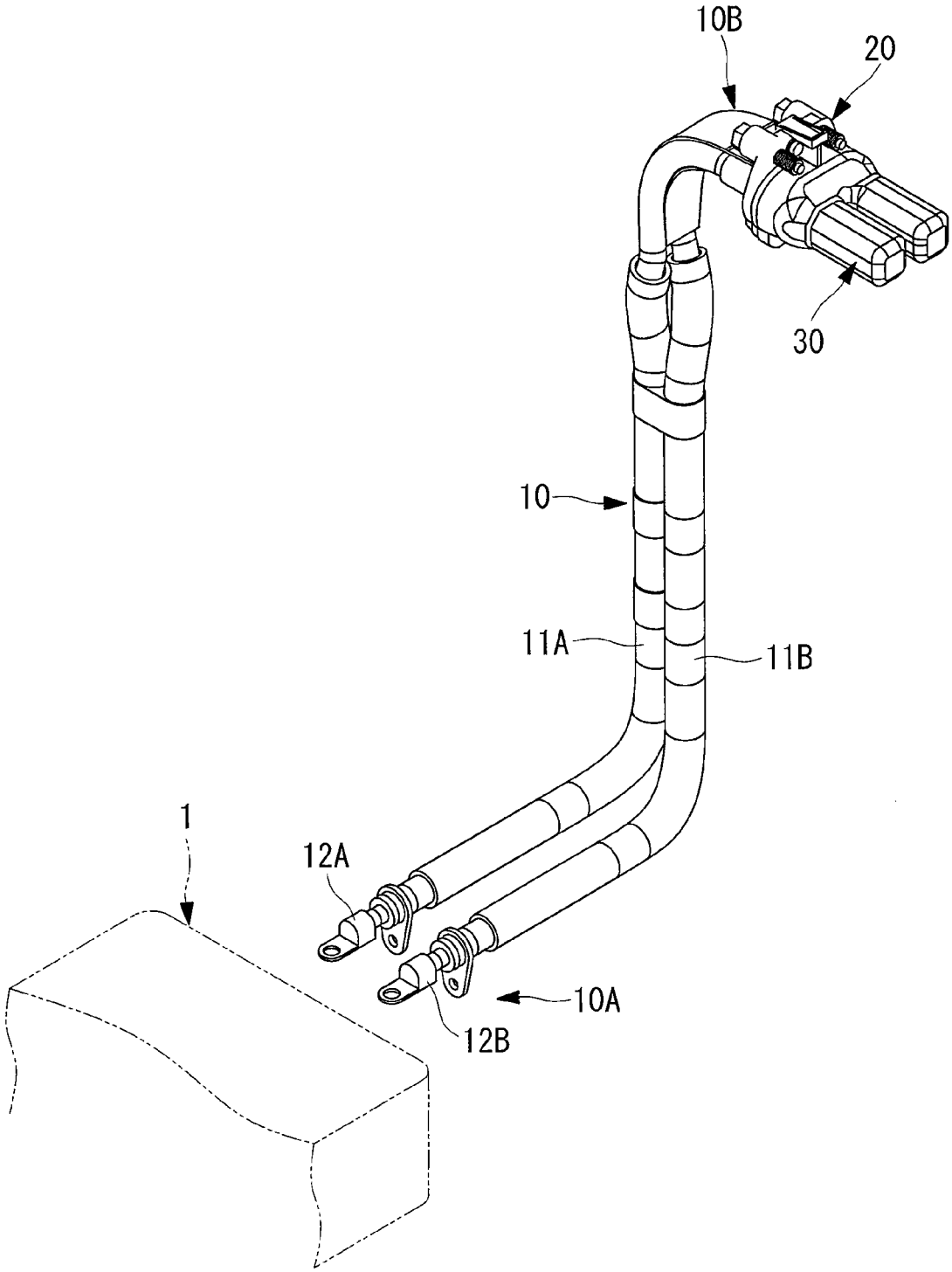
FIG. 1 is a perspective view of a harness assembly according to an embodiment of the present invention.

1: electrical compressor
10: harness assembly
20: connector
21: connector main body
22A, 22B: connector terminal
24: pin
30: connector terminal protection cap
31: cap main body
32: mating portion
33, 33A, 33B: cap-shaped cylindrical portion
34: partition
35, 36: pawl member
35B, 36B: pawl portion
35C, 36C: pressing operation portion
35D, 36D: linkage portion
35E, 36E: rib
36F, 36G: rear-surface rib
37: guiding hole
37A: protrusion

BEST MODE FOR CARRYING OUT THE INVENTION

An embodiment of the present invention will be described below with reference to FIGS. 1 to 10.

FIG. 1 shows perspective views of a harness assembly 10 applied to an electric compressor 1 of an air conditioner installed in a vehicle and a connector terminal protection cap 30 attached to a connector 20 of the harness. The electric compressor 1 is an inverter type electric compressor configured with a built-in electric motor (not shown) that is driven via an inverter device (not shown). Electric power from a battery installed in a vehicle is supplied to this electric compressor 1 via the harness assembly 10, and the electric compressor 1 is driven at variable speed by the electric motor via the inverter device.

Figure 2:
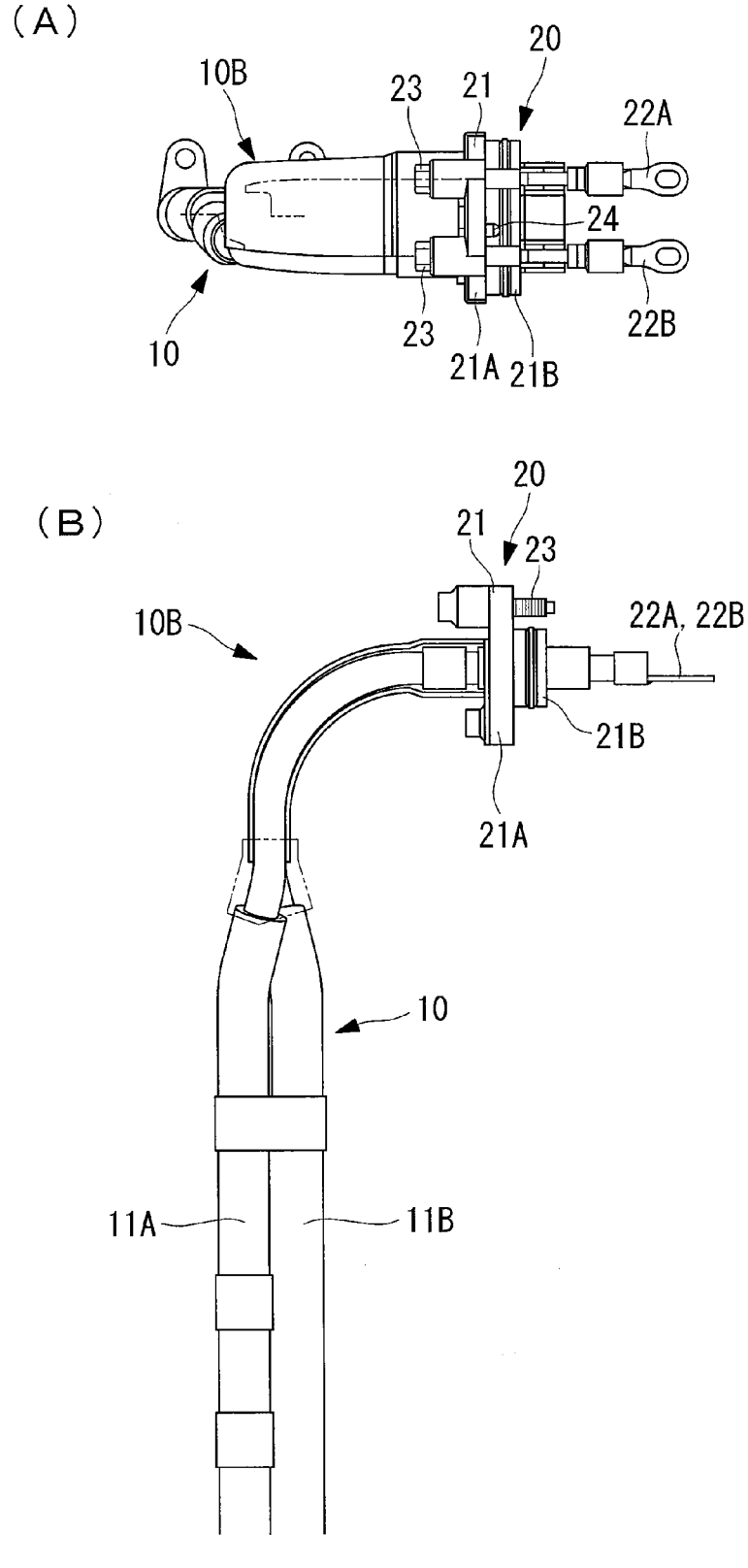
FIG. 2 includes a plan view (A) of the harness assembly shown in FIG. 1 and a side view (B) of a connector-side end portion thereof.
Figure 3:
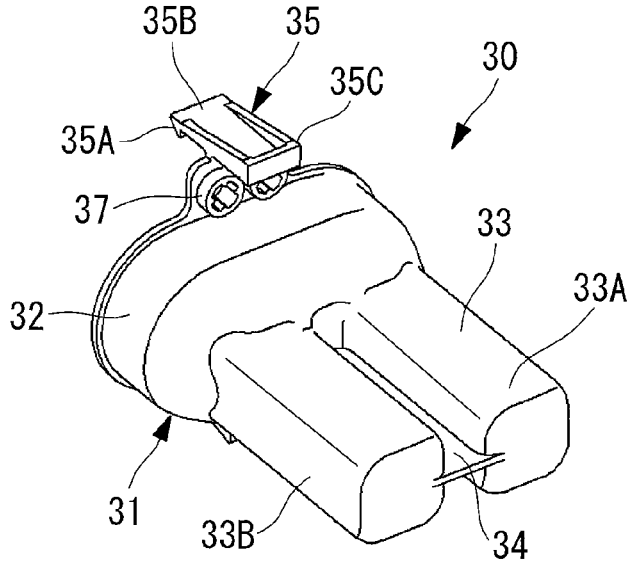
FIG. 3 is a perspective view of a connector terminal protection cap according to an embodiment of the present invention, viewed from a cap-shaped cylindrical portion side.
Figure 4:
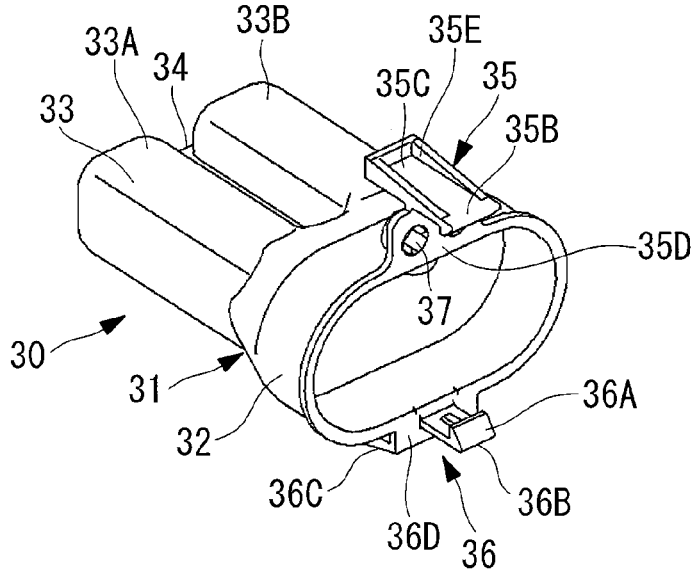
FIG. 4 is a perspective of the connector terminal protection cap according to an embodiment of the present invention, viewed from a mating portion side.
Figure 5:
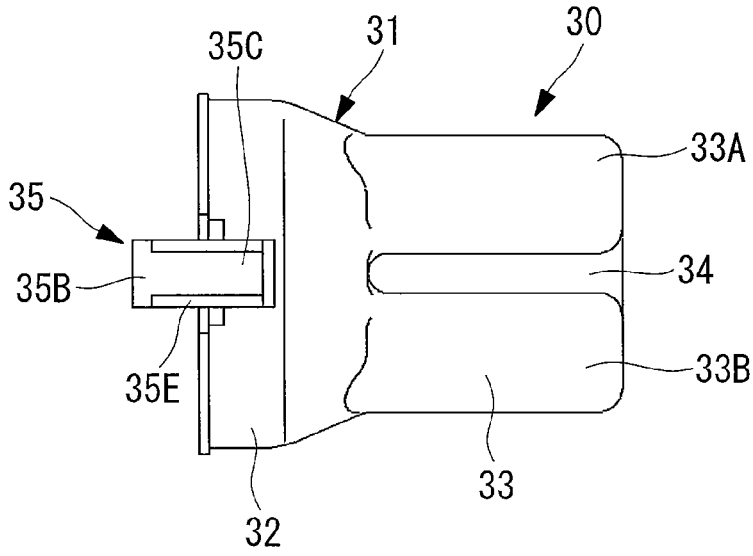
FIG. 5 is a top view of the connector terminal protection cap shown in FIG. 3.
Figure 6:
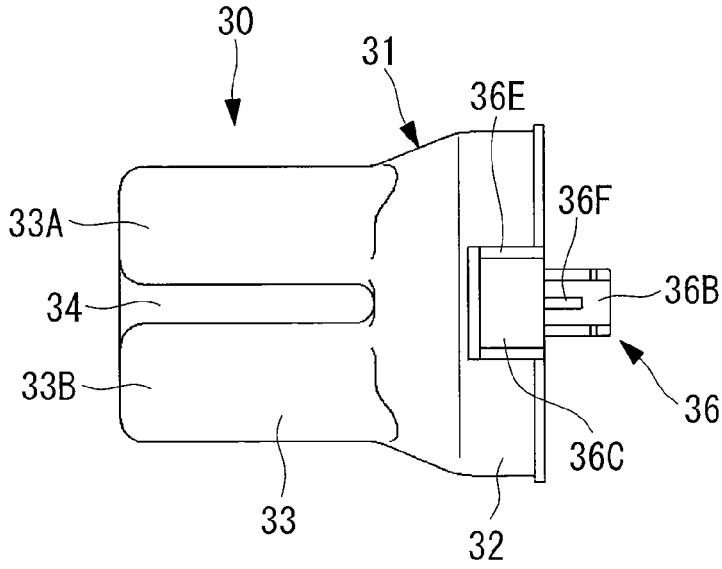
FIG. 6 is a bottom view of the connector terminal protection cap shown in FIG. 3.
Figure 7:
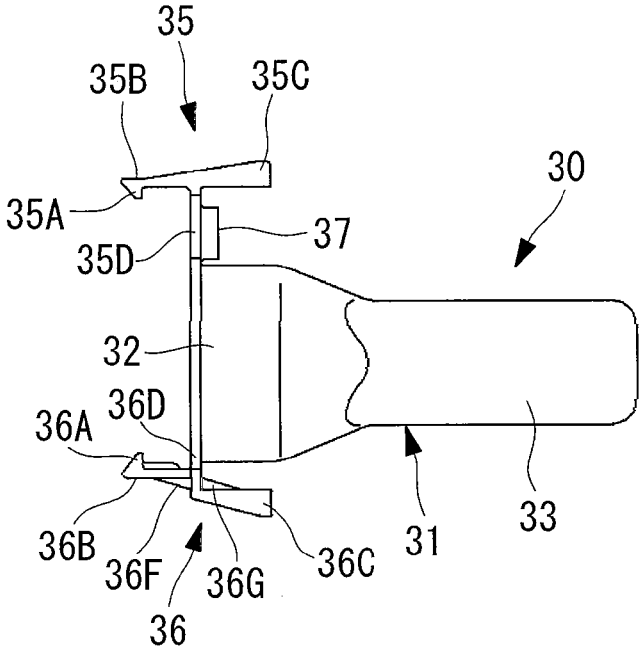
FIG. 7 is a left-side view of the connector terminal protection cap shown in FIG. 3.
Figure 8:
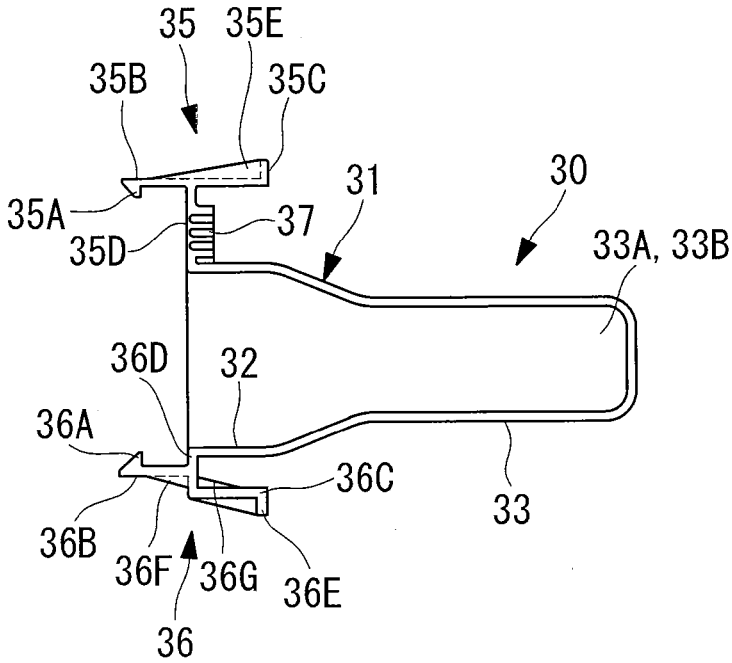
FIG. 8 is a longitudinal-sectional view of the connector terminal protection cap shown in FIG. 3, taken along the vertical direction.
Figure 9:
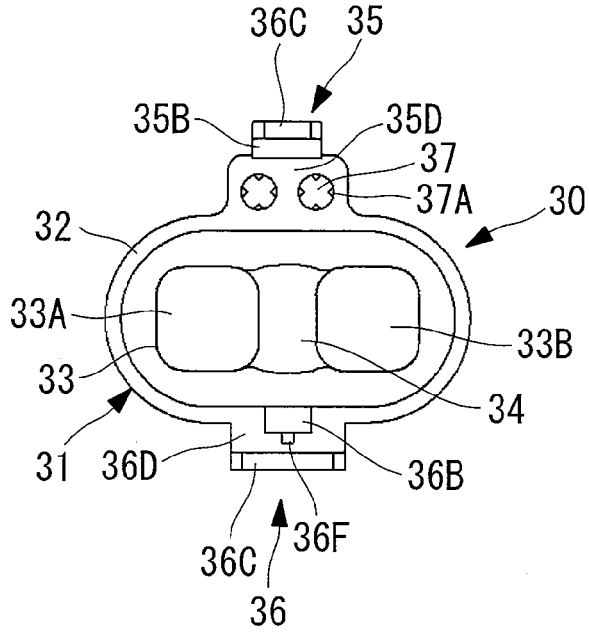
FIG. 9 is a front view of the connector terminal protection cap shown in FIG. 3, viewed from the cap-shaped cylindrical portion side.
Figure 10:
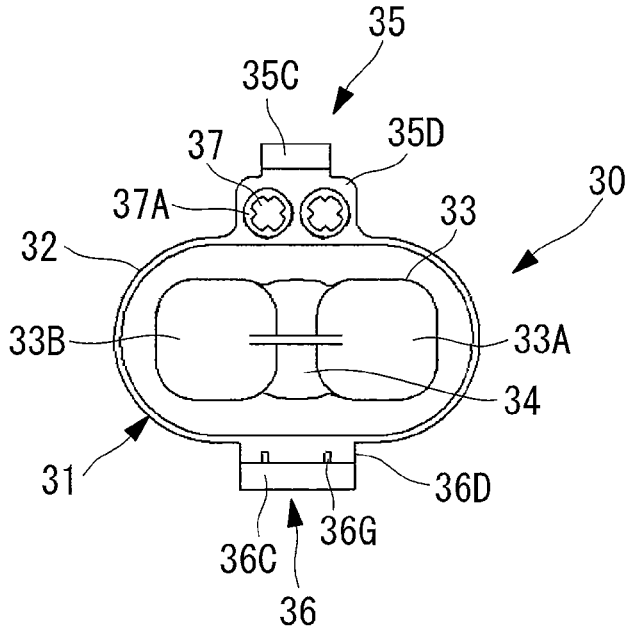
FIG. 10 is a front view of the connector terminal protection cap shown in FIG. 3, viewed from the mating portion side.

As shown in FIGS. 1 and 2, the harness assembly 10 is constituted of two cables 11A and 11B, which are insulation coated with corrugate tubes, wherein plus and minus terminals 12A and 12B are provided at one end 10A thereof, and the terminals 12A and 12B are connected to electric power source input terminals of the inverter device on the electric compressor 1 side. A connector 20 is provided on the other end 10B of the harness assembly 10, for connection to the battery installed in the vehicle.

The connector 20 includes a connector main body 21 composed of a flange portion 21A and a protruding portion 21B, which protrudes in an orthogonal direction from one surface of the flange portion 21A and which has an elongated circular shape in cross-section; a pair of plus and minus connector terminals 22A and 22B, protruding forward from the connector main body 21, that connect to the two insulation-coated cables 11A and 11B; two bolt screws 23, provided in the connector main body 21, that secure the connector 20 to the vehicle side; and a pin 24, provided in the connector main body 21, that achieves positioning of the connector terminal protection cap 30 at the time of its attachment.

As shown in FIGS. 3 to 10, the connector terminal protection cap 30 has a cap main body 31, which is configured by integrally forming a mating portion 32, having an elongated circular shape in cross-section, and which has an opening at one end thereof that fits to the outer circumference of the protruding portion 21B of the connector main body 21, and a cap-shaped cylinder portion 33, which is continuously formed in the shape of a cylinder from the mating portion 32 and covers the outer circumference of the connector terminals 22A and 22B. The cap-shaped cylinder portion 33 is divided into two cap-shaped cylinder portions 33A and 33B with a partition 34 so that a plurality of connector terminals 22A and 22B can be protected by individually covering the outer circumferences thereof, thus avoiding interference with each other.

The outer circumference of the mating portion 32 of the cap main body 31 is integrally provided with a pair of pawl members 35 and 36, in mutually opposing positions, which attach the connector terminal protection cap 30 to the connector 20 by anchoring the flange portion 21A of the connector main body 21. The pawl member 35 is integrally and coplanarly provided with a pawl portion 35B having a protruding pawl 35A that hooks to the flange portion 21A of the connector main body 21 and a pressing operation portion 35C that is pressed by fingers; and is integrally formed on the outer circumference of the mating portion 32, with a linkage portion 35D interposed therebetween. At the circumferential edge locations of the pressing operation portion 35C, a rigidity-enhancing erect rib 35E is integrally formed to extend to a rear surface of the pawl portion 35B. This pawl member 35 is configured such that the operating level of the pressing operation portion 35C by fingers is approximately proportionally transmitted to the pawl portion 35B, and is equivalent to the amount of movement of the pawl portion 35B.

On the other hand, the pawl member 36 which is integrally provided with a pawl portion 36B, having a protruding pawl 36A that hooks to the flange portion 21A of the connector main body 21 and a pressing operation portion 36C that is pressed by fingers, in a step-like manner with the pressing operation portion 36C arranged on the outer side; and is integrally formed on the outer circumference of the mating portion 32, with a linkage portion 36D interposed therebetween. At the circumferential edge locations of the pressing operation portion 36C, a rigidity-enhancing erect rib 36E is integrally formed. Additionally, the step-like portion of the pawl member 36 is provided with a rear surface rigidity-enhancing rib 36F that extends to the rear surface of the pawl portion 36B and a rear surface rigidity-enhancing rib 36G that extends to the rear surface of the pressing operation portion 36C.

With the rear-surface ribs 36F and 36G provided in the step-like portion, the pawl member 36 has greater rigidity than the pawl member 35. Furthermore, because the pawl portion 36B and the pressing operation portion 36C are configured in a step-like manner, the amount of movement of the pawl portion 35B is also arranged to be smaller than the operating level of the pressing operation portion 36C by fingers. Accordingly, the pawl member 36 is engaged/unhooked less easily than the pawl member 35.

In addition, the linkage portion 35D of the pawl member 35 has a greater height than the linkage portion 36D of the pawl member 36, and at least one guiding hole 37 is provided in the linkage portion 35D. This guiding hole 37 locates the attachment position of the connector terminal protection cap 30 by fitting to the pin 24 provided in the connector main body 21.

The guiding hole 37 is provided with four protrusions 37A in an inner circumferential surface thereof at equal intervals circumferentially, and the guiding hole 37 is assumed to be a cross shaped hole.

With the above configuration, this embodiment affords the following effects and advantages.

On a manufacturing line of compressors, the harness assembly 10 is mounted by connecting the terminals 12A and 12B of the one end 10A to the power source input terminals of the inverter device that is integrally installed in the electric compressor 1. The connector terminal protection cap 30 is attached to the connector 20 provided on the other end 10B of this harness assembly 10 for protecting the connector terminals 22A and 22B.

The electric compressor 1 is shipped from the compressor factory in this state to be transferred or transported to a vehicle assembly site. During this transfer or transport, the connector terminal protection cap 30 attached to the connector 20 protects the connector terminals 22A and 22B so that dirt, dust, water droplets, or the like does not attach to the connector terminals 22A and 22B of the harness assembly 10, and so that the terminals 22A and 22B are not damaged from coming into contact with other members.

The connector terminal protection cap 30 is attached to the connector 20 by having the mating portion 32 fitted to the protruding portion 21B of the connector main body 21 and by additionally having the pair of pawl members 35 and 36 anchored to the flange portion 21A of the connector main body 21. At this time, by having the guiding hole 37 provided in the linkage portion 35D fitted to the pin 24 provided in the connector main body 21, misalignment or misattachment of the connector terminal protection cap 30 is prevented, and thereby, it is attached to the connector 20 in a state in which it is positioned at a predetermined position.

In addition, when attaching/detaching the connector terminal protection cap 30 to/from the connector 20, the pressing operation portions 35C and 36C of the pair of pawl members 35 and 36 are pressed from both sides with fingers in a pinching manner. Depending on the level of this pressing operation, the pawl portions 35B and 36B are individually moved, and the protruding pawls 35A and 36A are engaged with/unhooked from the flange portion 21A of the connector main body 21. Accordingly, the connector terminal protection cap 30 is easily attached to/detached from the connector 20.

Thus, as described above, by attaching the connector terminal protection cap 30 to the connector 20, attachment of dirt, dust, water droplets, or the like to the connector terminals 22A and 22B or damage, etc. to the terminals 22A and 22B during transfer or transport can be prevented. In addition, because the cap main body 31 of the connector terminal protection cap 30 is attached to the connector 21 in a freely attachable/detachable manner by engaging/unhooking of the pawl members 35 and 36, the cap main body 31 does not easily come off due to vibrations or contact with other members during transfer or transport; and when removing the cap main body 31 at an assembly site, it is easily removed by unhooking the pawl members 35 and 36.

In particular, the pair of pawl members 35 and 36 are provided with the pawl portions 35B and 36B, having the protruding pawls 35A and 36A that are anchored to the flange portion 21A of the connector main body 21, and the pressing operation portions 35C and 36C; and it is possible to engage/unhook the pawl portions 35B and 36B with/from the flange portion 21A of the connector main body 21 by operating the pressing operation portions 35C and 36C from both sides in a pinching manner, thus moving the pawl portions 35B and 36B in accordance with the operating level. Therefore, by operating the pressing operation portions 35C and 36C, the cap main body 31 can be easily attached to and detached from the connector main body 21.

In addition, because the ribs 35E and 36E are integrally formed at least at the circumferential edge locations of the pressing operation portions 35C and 36C of the pawl members 35 and 36, the rigidity of the pressing operation portions 35C and 36C can be ensured. Therefore, it is possible to easily attach/detach the cap main body 31 to/from the connector main body 21 by reliably transmitting an operating force exerted on the pressing operation portions 35C and 36C to the pawl portions 35B and 36B, Furthermore, in the pawl member 35, the pawl portion 35B and the pressing operation portion 35C are integrally and coplanarly provided, and the pawl portion 35B is moved proportionally to the operating level of the pressing operation portion 35C; therefore, it is possible to make the pawl portion 35B relatively easy to come off. On the other hand, in the pawl member 36, the pawl portion 36B and the pressing operation portion 36C are provided in a step-like manner with the pressing operation portion 36C arranged on the outer side. Moreover, in this step-like portion, the rear-surface ribs 36F and 36G are integrally formed to extend to the rear surface of the pawl portion 36B and the rear surface of the pressing operation portion 36C, respectively, and thereby, the rigidity thereof is increased, making the step-like portion hard to deform. Accordingly, it is possible to make the pawl portion 36B hard to come off by making the amount of movement of the pawl portion 35B small relative to the operating level of the pressing operation portion 36C. With such a configuration, it is possible to make the cap main body 31 hard to come off due to vibrations, contact with other members, etc. while allowing for easy removal when removing it at an assembly site.

Additionally, because the cap main body 31 can be attached by fitting the guiding hole 37 of the cap main body 31 to the pin 24 provided in the connector main body 21, misalignment of the attachment position or misattachment of the connector terminal protection cap 30 can be prevented. The pin 24 provided in the connector main body 21 can be fitted to the center of the guiding hole 37 at this time, appropriately guided thereto by the protrusions 37A provided on the inner circumferential surface of the guiding hole 37; therefore, the connector terminal protection cap 30 can be attached so as not to be misaligned.

Furthermore, the pair of connector terminals 22A and 22B are protected by the cap-shaped cylinder portions 33A and 33B separately formed for each terminal by the partition 34; therefore, the connector terminals 22A and 22B can be individually protected, avoiding interference with each other.

Moreover, because attachment of dirt, dust, or water droplets to the connector terminals 22A and 22B or damage to the terminals can be prevented during transfer or transport, the installation of the electric compressor 1 and the connection of the harness assembly 10 to the power source side can be smoothly carried out at an assembly site.

Note that the present invention is not limited to the invention according to the above-described embodiment; appropriate modifications thereof are possible without departing from the sprit thereof. For example, the invention does not prevent sealing of an interior portion of the connector terminal protection cap 30 between the mating portion 32 of the cap main body 31 and the protruding portion 21B of the connector main body 21 by placing a sealing material such as O-ring on the outer circumference of the protruding portion 21B. In addition, the construction material of the connector terminal protection cap 30 is not particularly limited so long as it is a plastic material that does not damage the connector 20; and, for example, polypropylene (PP) and the like is suitably applied.

The invention claimed is:

1. A connector terminal protection cap that is made of plastic and is attached to a connector provided at one end of a harness to protect terminals of the connector, the connector terminal protection cap comprising:

a cap main body that has an opening at one end thereof that serves as a mating portion to be fitted to a connector main body and a cap-shaped cylinder portion that is formed integrally with and continuously from the mating portion to cover an outer circumference of the terminals; and a pair of pawl members that are provided at opposing positions on an outer circumference of the mating portion of the cap main body, anchoring to the connector main body, thereby attaching the cap main body to the connector main body in a freely attachable/detachable manner, wherein:

the pair of pawl members are provided with pressing operation portions and pawl portions that are anchored to the connector main body;

these pawl portions and pressing operation portions are integrally formed on the outer circumference of the mating portion of the cap main body, with linkage portions interposed therebetween;

on one of the pair of pawl members, the pawl portion and the pressing operation portion are integrally and coplanarly provided; and on the other of the pair of pawl members, the pawl portion and the pressing operation portion are provided in a step-like manner relative to the linkage portion, with the pressing operation portion on an outer side thereof, so as to make an amount of movement of the pawl portion small relative to an operating level of the pressing operation portion, wherein said cap seals the connector terminals and prevents the connector terminals from connecting, wherein said cap main body has a shape of two elongated tubes connected to said mating portion.

2. The connector terminal protection cap according to claim 1, wherein ribs are integrally formed, at least on a circumferential edge of the pressing operation portions of the pawl members.

3. The connector terminal protection cap according to claim 1, wherein, on the step-like portion of the other pawl member, rear-surface ribs are integrally formed to extend to a rear surface of the pawl portion and a rear surface of the pressing operation portion, respectively.

4. The connector terminal protection cap according to claim 1 or claim 2, wherein the mating portion of the cap main body is provided with a guiding hole that fits to a pin provided on the connector main body side.

5. The connector terminal protection cap according to claim 4, wherein the guiding hole is a cross-shaped hole with protrusions provided on an inner circumferential surface thereof.

6. The connector terminal protection cap according claim 1, wherein the cap-shaped cylinder portion is formed by separating the cap-shaped cylinder portion with a partition for each of a plurality of the connector terminals.

7. A harness assembly that is connected at one end to power source input terminals of an electric compressor and is provided with a connector at the other end to be connected to a power source, wherein the connector terminal protection cap according to claim 1, which covers an outer circumference of terminals of the harness assembly, is attached to the connector main body in a freely attachable/detachable manner, via a pair of pawl members.

8. The connector terminal protection cap according to claim 1, wherein the mating portion of the cap main body is provided with a guiding hole that fits to a pin provided on the connector main body side.

9. The connector terminal protection cap according to claim 8, wherein the guiding hole is a cross-shaped hole with protrusions provided on an inner circumferential surface thereof.

10. The connector terminal protection cap according to claim 3, wherein the mating portion of the cap main body is provided with a guiding hole that fits to a pin provided on the connector main body side.

11. A connector terminal protection cap that is made of plastic and is attached to a connector provided at one end of a harness to protect terminals of the connector, the connector terminal protection cap comprising:

a cap main body that has an opening at one end thereof that serves as a mating portion to be fitted to a connector main body and a cap-shaped cylinder portion that is formed integrally with and continuously from the mating portion to cover an outer circumference of the terminals; and a pair of pawl members that are provided at opposing positions on an outer circumference of the mating portion of the cap main body, anchoring to the connector main body, thereby attaching the cap main body to the connector main body in a freely attachable/detachable manner, wherein the mating portion of the cap main body is provided with a guiding hole that fits to a pin provided on the connector main body side, and wherein the guiding hole is a cross-shaped hole with protrusions provided on an inner circumferential surface thereof.

12. A connector terminal protection cap that is made of plastic and is attached to a connector provided at one end of a harness to protect terminals of the connector, the connector terminal protection cap comprising:

a cap main body that has an opening at one end thereof that serves as a mating portion to be fitted to a connector main body and a cap-shaped cylinder portion that is formed integrally with and continuously from the mating portion to cover an outer circumference of the terminals; and a pair of pawl members that are provided at opposing positions on an outer circumference of the mating portion of the cap main body, anchoring to the connector main body, thereby attaching the cap main body to the connector main body in a freely attachable/detachable manner, wherein said cap is removable from the protected connection terminals, wherein said cap main body has a shape of two elongated tubes connected to said mating portion.

13. The connector terminal protection cap of claim 11, wherein said cap is removable from the protected connector terminals.

14. The connector terminal protection cap of claim 11, wherein said cap main body has a shape of two elongated tubes connected to said mating portion.

15. A connector terminal protection cap that is made of plastic and is attached to a connector provided at one end of a harness to protect terminals of the connector, the connector terminal protection cap comprising:

a cap main body that has an opening at one end thereof that serves as a mating portion to be fitted to a connector main body and a cap-shaped cylinder portion that is formed integrally with and continuously from the mating portion to cover an outer circumference of the terminals; and a pair of pawl members that are provided at opposing positions on an outer circumference of the mating portion of the cap main body, anchoring to the connector main body, thereby attaching the cap main body to the connector main body in a freely attachable/detachable manner, wherein said cap is removable from the protected connection terminals, wherein the mating portion of the cap main body is provided with a guiding hole that fits to a pin provided on the connector main body side, and wherein the guiding hole is a cross-shaped hole with protrusions provided on an inner circumferential surface thereof.

16. The connector terminal protection cap of claim 11, wherein the mating portion of the cap main body is provided with a guiding hole that fits to a pin provided on the connector main body side, and wherein the guiding hole is a cross-shaped hole with protrusions provided on an inner circumferential surface thereof.

* * * * *